United States Patent [19]

Bowman et al.

[11] 4,219,869

[45] Aug. 26, 1980

[54] APPARATUS FOR MOUNTING AND SUPPLYING POWER TO A LUMINAIRE

[75] Inventors: Robert W. Bowman; Raymond A. Brown, both of Crawfordsville, Ind.

[73] Assignee: National Service Industries, Inc., Atlanta, Ga.

[21] Appl. No.: 910,847

[22] Filed: May 30, 1978

[51] Int. Cl.[2] ..... F21S 1/02; F21S 1/04

[52] U.S. Cl. ..... 362/147; 52/28; 339/75 M; 339/119 L; 362/404

[58] Field of Search ..... 362/147, 404, 405, 406, 362/217, 219, 220, 221; 315/185 R, 189, 191; 307/157; 339/119 R, 119 L, 121, 75 M, 122 F, 135; 174/49, 59, 60; 52/28

[56] References Cited

U.S. PATENT DOCUMENTS

| | | | |
|---|---|---|---|
| 2,847,561 | 8/1958 | Huerkamp | 362/220 |
| 2,907,872 | 10/1959 | Wilson | 362/220 |
| 3,123,310 | 3/1964 | Dameral | 362/221 |
| 4,001,571 | 1/1977 | Martin | 362/147 |

*Primary Examiner*—Samuel W. Engle
*Assistant Examiner*—Donald P. Walsh
*Attorney, Agent, or Firm*—Oliver E. Todd, Jr.

[57] ABSTRACT

A device for mounting and supplying electrical power to a luminaire. The device includes three connectors mounted in a housing. The connectors on the device electrically interconnect two cables and a lighting circuit in the luminaire. Power is applied from one cable through the device to the luminaire and to the other cable which supplies power to another luminaire. A bracket on the top of the housing for mounting the device to a building structure is adjustable to compensate for fixture balance and the weight of the cables connected to the device. When the luminaire is releasably attached to the device, one of the connectors on the device engages a mating connector on the luminaire for energizing the lighting circuit. The luminaire can be detached from the device without interrupting power to other luminaires in the same circuit.

9 Claims, 9 Drawing Figures

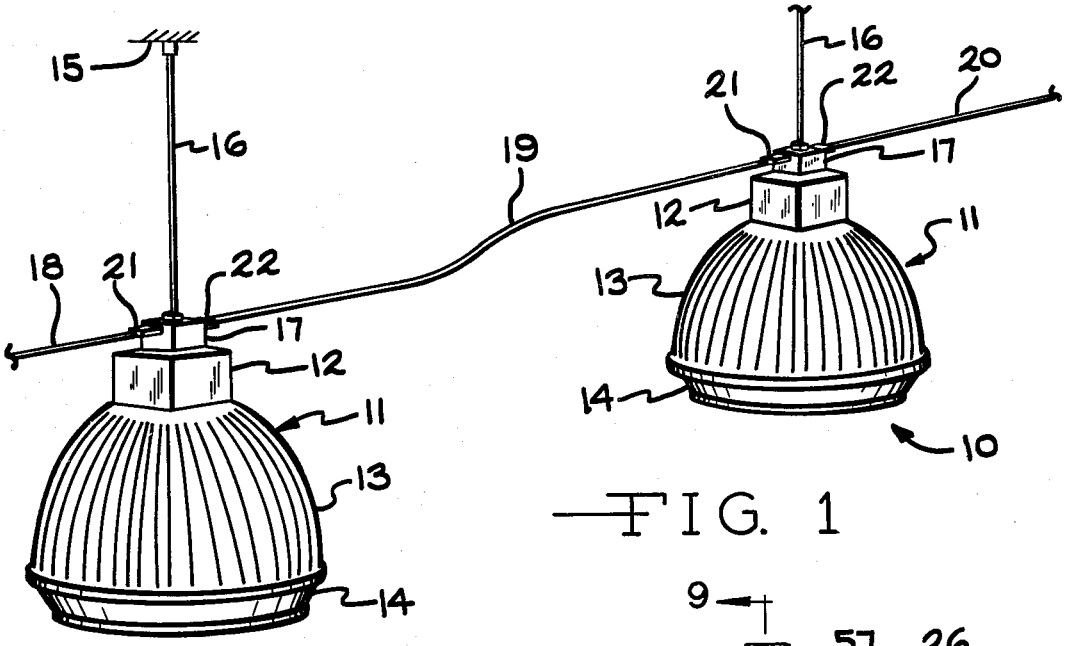
FIG. 1
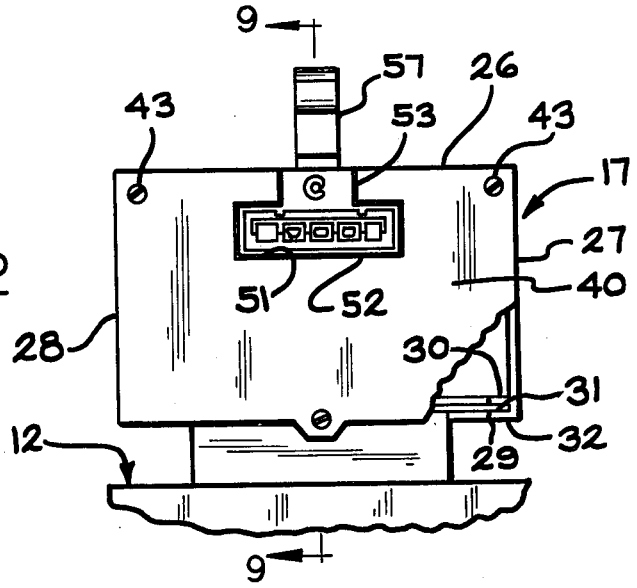
FIG. 2
FIG. 3
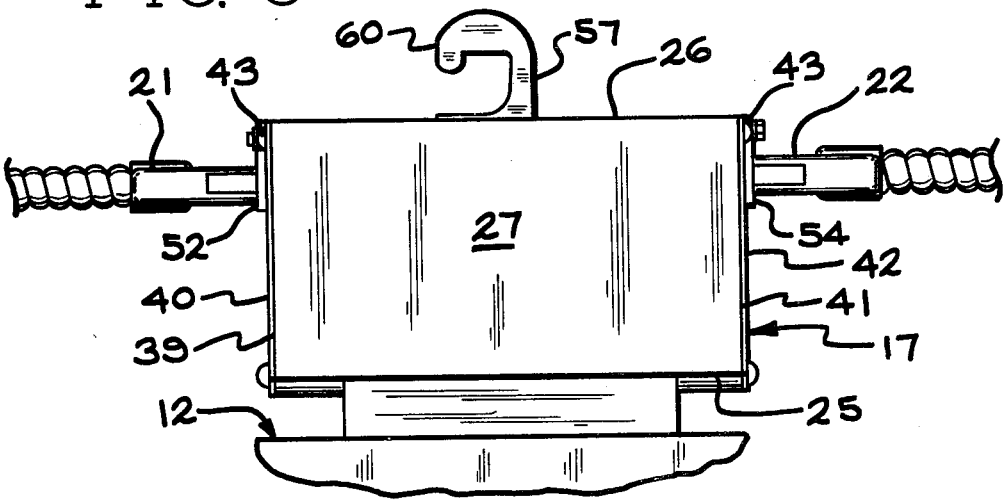

APPARATUS FOR MOUNTING AND SUPPLYING POWER TO A LUMINAIRE

BACKGROUND OF THE INVENTION

This invention relates to electrical lighting systems and more particularly to an improved device for mounting and supplying electrical power to luminaires such as indoor industrial lighting fixtures of the type using high intensity discharge lamps.

Interior industrial lighting is often provided with luminaires containing high intensity discharge (HID) lamps, such as mercury lamps, metal halide lamps or high pressure sodium lamps. Luminaires of this type typically consist of a ballast housing containing a ballast circuit for energizing the lamp and a downwardly directed reflector mounted on the ballast housing. One typical method for installing lighting fixtures of this type is to attach the ballast housing to a junction box which is in turn anchored to a building structure. Wiring within the junction box is then permanently connected to the ballast circuit for supplying power to the lamp. The junction box is mounted, for example, by a rod or pendent having an upper end anchored to the building structure and a lower end which threadably engages the junction box. Or, the junction box can be attached directly with bolts to the building structure or to an I beam or other member within the building. Problems occur with a luminaire installation of this type when it is desired to change the location of the luminaires or to remove a luminaire, for example, for repair or maintenance. Power is typically supplied in a branch circuit which connects from fixture junction box to fixture junction box for a number of luminaires. When one of the luminaires in the circuit is to be disconnected, power must be removed from the entire circuit. This is often undesirable since it may require shutting off the lights for a large industrial area. Another problem occurs when it is necessary to change switching for selected ones of a number of luminaires in a circuit or to relocate one or more luminaires as lighting requirements change. Since the circuit is permanently connected from fixture to fixture, considerable difficulty and expense is encountered in modifying the circuit connections to selected fixtures.

U.S. Pat. No. 4,001,571, for example, discloses a relocatable lighting system in which power is supplied to a plurality of lighting fixtures through a branch circuit. The branch circuit is formed by branch circuit cables which connect from fixture-to-fixture. Any fixture can be disconnected from the circuit without removing power from the circuit. However, the system of this patent does not deal with problems relating to both mounting and supplying power to luminaires in a relocatable system.

Luminaires for high intensity discharge lamps often are designed to illuminate the largest possible area without providing high angle glare. High angle glare occurs when the lamp is located within the normal field of vision of a person standing below and to one side of the luminaire. When the luminaire is designed for illuminating a maximum work area, it is important that the luminaire be mounted with a vertical orientation. If the luminaire is inclined by only a small amount, such as about 5°, undesirable high angle glare may occur. This inclination will also interrupt the total uniformity of the lighting layout in the work area.

SUMMARY OF THE INVENTION

According to the present invention, an improved device is provided for both mounting and supplying electrical power to a luminaire in a lighting system. The device permits disconnecting the luminaire from the circuit without interrupting power to other luminaires connected to the same circuit. Furthermore, the device facilitates relocating either the luminaire or circuits connected to specific luminaires, for example, when it is necessary to change switching or wiring connections to only a few luminaires in a circuit.

The device of the present invention generally includes three connectors mounted in a housing. The connectors in the device interconnect two cables and a lighting circuit in a luminaire mounted on the device. Power is applied through one cable and the device to both the luminaire and the other cable which in turn connects to a similar device which mounts the next luminaire in the circuit. The location of a bracket on the top of the housing for mounting the device to a building structure is adjustable to compensate for fixture imbalance and for the weight of the cables. This permits accurate vertical alignment of the luminaire after it is mounted. When a luminaire is releasably attached to the device, one of the connectors on the device engages a mating connector on the luminaire for supplying power to the luminaire. When the luminaire is released from the device, the connectors separate to disconnect power from the luminaire. However, the circuit connection is maintained between the two cables connected to the device.

Accordingly, it is an object of the invention to provide an improved device for mounting and supplying electrical power to lighting fixtures.

Another object of the invention is to provide an improved device for mounting and supplying electrical power to a luminaire connected in circuit with a plurality of luminaires which permit disconnecting such luminaire without interrupting power to the other luminaire.

Still another object of the invention is to provide an improved device for mounting and supplying electrical power to a luminaire which facilitates modification of the wiring to the luminaire and to other luminaires connected in the same circuit.

Other objects and advantages of the invention will become apparent from the following detailed description, with reference being made to the accompanying drawings.

BRIEF DESCRIPTION OF THE DRAWINGS

FIG. 1 is a fragmentary perspective view of a lighting system showing two luminaires, each connected to an electrical circuit and mounted from a building structure with a device constructed in accordance with the present invention;

FIG. 2 is a fragmentary end elevational view of the device of the present invention for mounting and supplying electrical power to a luminaire;

FIG. 3 is a fragmentary side elevational view of the device of the present invention for mounting and supplying electrical power to a luminaire;

DESCRIPTION OF THE PREFERRED EMBODIMENT

Figures 4, 5, 6:
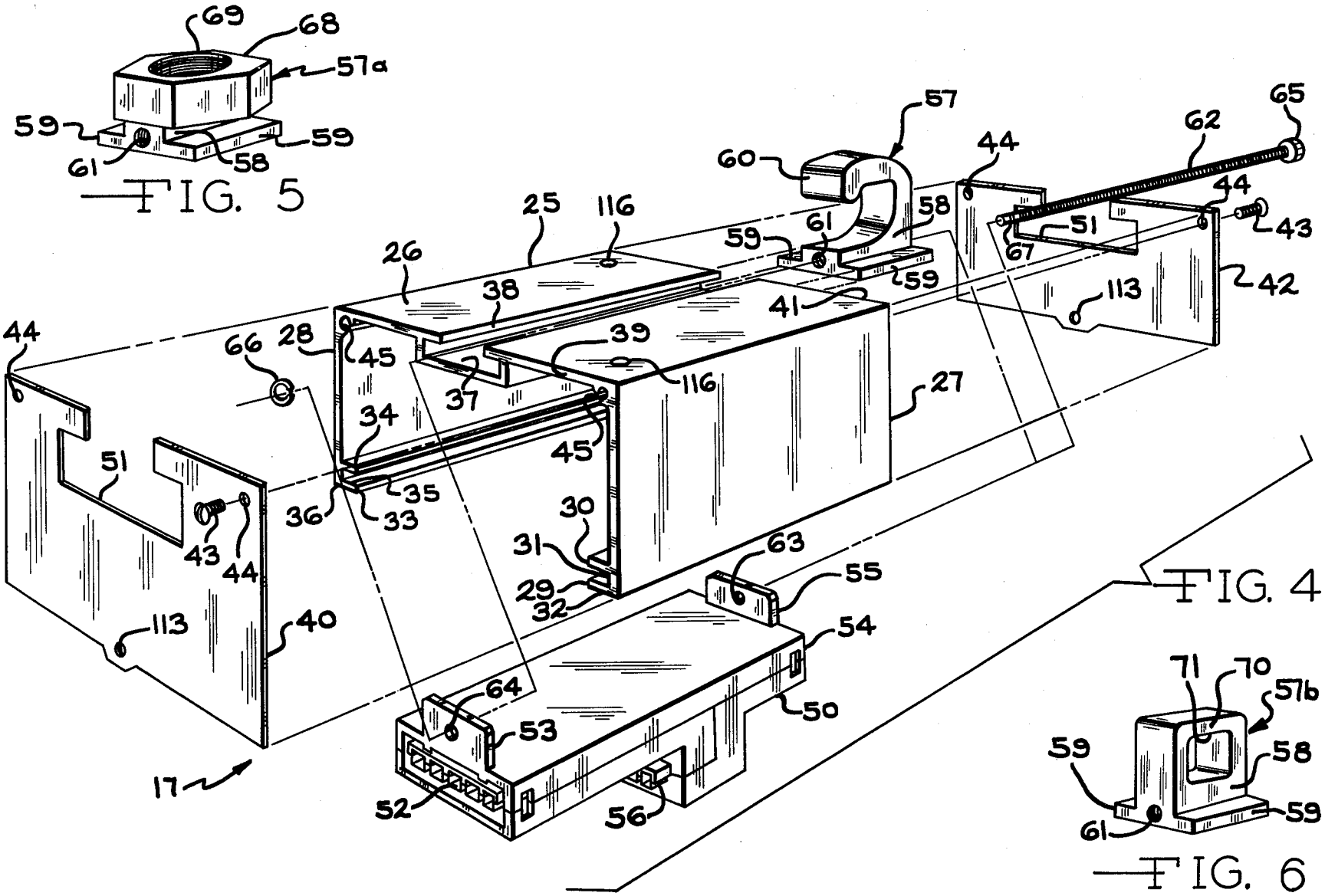
FIG. 4 is an exploded perspective view of the device of the present invention for mounting and supplying electrical power to a luminaire and provided with a hook bracket for attaching the device to a building structure.
FIG. 5 is a perspective view of a threaded bracket for use with the device of FIG. 4.
FIG. 6 is a perspective view of a loop bracket for use with the device of FIG. 4.

Turning now to the drawings and particularly to FIG. 1, a fragmentary portion of a relocatable plug-in lighting system 10 is shown. The lighting system 10 includes a plurality of luminaires 11 which are illustrated as a type including a ballast housing 12, a reflector 13 and a refractor 14. The ballast housing 12 encloses a ballast circuit for operating an HID lamp (not shown) such as a mercury lamp, a metal halide lamp or a high pressure sodium lamp. The lamp is mounted within the reflector 13 which directs light from the lamp downwardly through the refractor 14 to illuminate a work area.

The luminaires 11 are mounted in a building structure to illuminate an area. A fragmentary portion of a building roof or ceiling structure 15 is illustrated with a separate pendent, rod or stem 16 attached to the ceiling structure 15 for each of the luminaires 11. A separate device 17 in accordance with the present invention is attached to each pendent 16. Each device 17 mounts one of the luminaires 11 and also establishes electrical connection to such mounted luminaire 11. The fragmentary portion of the lighting system 10 shown in FIG. 1 has three cables 18, 19 and 20 with the cables 18 and 20 shown in fragmentary. The cables 18–20 are identical and are provided with input and output connectors 21 and 22, respectively, at the cable ends. The input connector 21 on the cable 18 is connected to supply power to the device 17 for one of the luminaires 11 and the other end of the cable 18 is connected to a source of electrical power (not shown) such as an upstream device 17 for another luminaire or a power distribution junction box. The output connector 22 and the input connector 21 on the cable 19 are connected between two devices 17 for mounting two separate luminaires 11. The output connector 22 on the cable 19 receives power from an output of the upstream device 17 while the input connector 21 on the cable 19 supplies power to an input to the device 17 mounting the next downstream luminaire 11. The cable 20 receives power from the device 17 for such luminaire and supplies this power to a downstream luminaire (not shown). It should be noted that power connections are maintained through each of the devices 17 between the two cables and the luminaire 11 connected to the device, such as between the cables 18 and 19 and a mounted luminaire 11 or between the cables 19 and 20 and a mounted luminaire 11. During cleaning, servicing or other maintenance work on a luminaire 11 or when a luminaire is no longer necessary to produce a required level of illumination, the luminaire may be disconnected from the device 17 without interrupting power in the circuit. Furthermore, since power is distributed to the different luminaires 11 through cables terminating in identical connectors 21 and 22, the cables may be relocated for changing lighting requirements.

Turning now to FIGS. 2–4, details are shown for the device 17 for mounting and supplying electrical power to the luminaires 11. The device 17 has an outer housing 25 which, preferably, is extruded from an aluminum alloy or a similar material. The outer housing 25 has a generally C-shaped cross section defined by a top 26 and two depending sides 27 and 28. The side 28 has two inwardly directed flanges 29 and 30 defining a groove 31 along a lower edge 32 and the side 28 has two inwardly directed flanges 33 and 34 defining a groove 35 extending along a lower edge 36. The grooves 31 and 35 are in alignment and open toward each other. A channel 37 having an upwardly directed opening 38 extends along the length of, and is centered on, the housing top 26. An open end 39 on the outer housing 25 is closed by a cover plate 40 and a second open end 41 on the outer housing 25 is closed by a cover plate 42. The cover plates 40 and 42 are attached to the outer housing 25 by means of screws 43 passed through holes 44 in the cover plates 40 and 42 and threaded into aligned holes 45 in the outer housing 25.

An inner connector housing 50 is located within the outer housing 25 and extends through T-shaped openings 51 in the cover plates 40 and 42. An input connector 52 and a flange 53 extend through the opening 51 in the cover plate 40 and an output connector 54 and a flange 55 extend through the opening 51 on the cover plate 42. The flanges 53 and 55 are spaced apart by a distance slightly greater than the length of the outer housing 25. When the device 17 is assembled, the flanges 53 and 55 are in alignment with opposite ends of the channel 37 formed along the outer housing top 26. The connectors 52 and 54 are designed for receiving the input and output connectors 21 and 22, respectively, on the cables 18–20 or on similar cables supplying power in the lighting system 10 of FIG. 1. The connector housing 50 also includes a third connector 56 which engages a mating connector on the luminaire 11 supported from the device 17, as will be discussed in greater detail below.

A mounting bracket 57 is retained in the channel 37 on the outer housing 25. The mounting bracket 57 includes a central member 58 which passes through the opening or slot 38 in the outer housing top 26 and opposing, outwardly directed flanges 59 which are received by the channel 37 but will not pass through the opening or slot 38. An upper portion 60 of the mounting bracket 57 is in the shape of a hook for attaching the device 17 to a mating member (not shown) located in a building structure. The mating member, for example, may be in the form of a loop attached to the bottom of a conduit or rod depending from a ceiling in the building structure. The bracket 57 also includes a threaded opening 61 which extends in a direction parallel to the slot or opening 38 in the outer housing top 26. A travel screw 62 extends through an opening 63 in the connector housing flange 55, threadably engages the opening 61 in the bracket 57 and extends through an opening 64 in the connector housing flange 53. The travel screw 62 is retained by an integral head 65 which abuts the flange 55 and a C-shaped retainer 66 which engages a groove 67 in the travel screw 62 and abuts the flange 53. By rotating the screw 62, the bracket 57 either is centered in the channel 37 or is positioned towards one of the connectors 52 or 54. The location of the bracket 57 in the channel 37 is adjusted to compensate for imbalances on the device 17 from an attached luminaire 11 and from different length cables attached to the connectors 52 and 54 to orient the luminaire 11 on a vertical axis.

The bracket 57, when used, may be modified to provide any desired means for attaching the device 17 to a building structure. FIG. 5 shows a modified mounting bracket 57*a* which again has the central member 58, the flanges 59 and the threaded opening 61. However, the upper portion or hook 60 of the bracket 57 has been replaced in the bracket 57*a* with a nut 68 having a threaded opening 69 for engaging a threaded end of a rod, stem or pendent. A further modified mounting bracket 57*b* is shown in FIG. 6 in which the upper portion 60 of the bracket 57 has been replaced with a closed loop 70 which defines an opening 71. A hook or a heavy gauge wire support may be passed through the opening 71 for attaching bracket 57*b* to a building structure. Again, the bracket 57*b* also includes the central member 58, the flanges 59 and the threaded opening 61 as in the mounting bracket 57.

Figure 7:
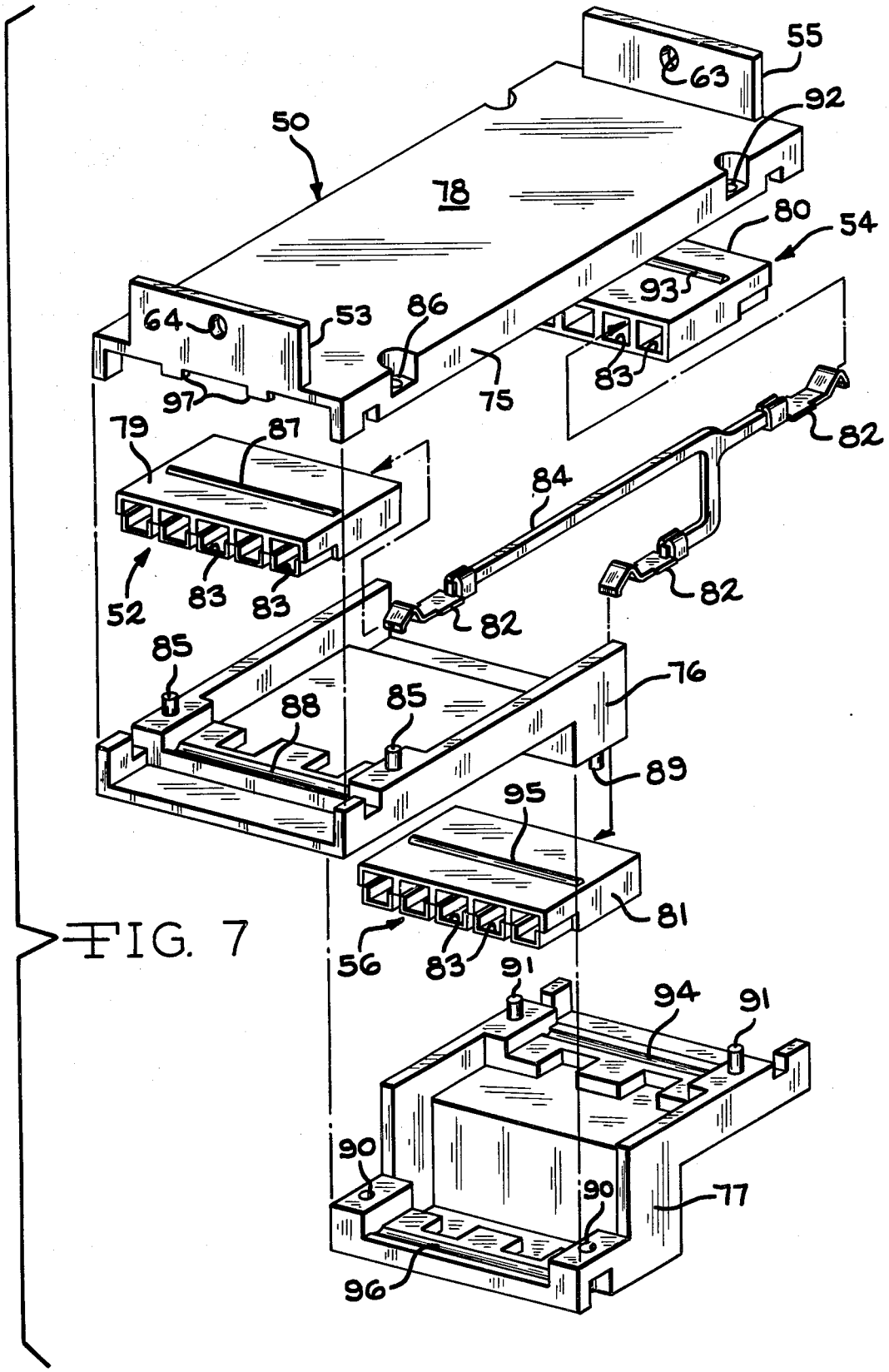
FIG. 7 is an exploded perspective view of the three connectors and an inner connector housing from the device of the present invention.

Turning now to FIG. 7, details are shown for the connectors 52, 54 and 56 and the connector housing 50. The connector housing 50 includes a mounting plate 75, a primary clamping plate 76 and a secondary clamping plate 77. The flanges 53 and 55 project upwardly from a top 78 of the mounting plate 75. An insulator block 79 is clamped between the primary clamping plate 76 and the mounting plate 75 to form the connector 52, a second and identical insulator block 80 is clamped between the secondary clamping plate 77 and the mounting plate 75 to form the connector 54 and a third identical insulator block 81 is clamped between the secondary clamping plate 77 and the primary clamping plate 76 to form the connector 56. Terminals 82 are located within openings 83 in the insulator blocks 79–81. Corresponding ones of the terminals 82 of the connectors 52, 54 and 56 are interconnected by means of a copper bus 84. Only a single exemplary bus 84 is shown in FIG. 7, although a separate bus 84 will be used for each separate circuit connected through the device 17. In other words, the connectors 52, 54 and 56 are electrically connected in parallel.

The primary clamping plate 76 is attached to the mounting plate 78 by means of pins 85 on the primary clamping plate 76 which pass through openings 86 in the mounting plate 75 and are deformed to lock the plates 75 and 76 together. Ribs 87 on opposite sides of the insulator block 79 engage grooves 88 on the plates 75 and 76 to retain the insulator block 79 in the housing 50. Pins 89 also on the primary clamping plate 76 pass through aligned openings 90 on the mounting plate 75 and are deformed to connect the plates 76 and 77 together and pins 91 on the secondary clamping plate 77 pass through aligned openings 92 on the mounting plate 75 and are deformed to connect the plates 75 and 77 together. Ribs 93 on opposite sides of the insulator block 80 engage corresponding grooves 94 in the mounting plate 75 and the secondary clamping plate 77 and ribs 95 on the insulator block 81 engage corresponding grooves 96 on the primary and secondary clamping plates 76 and 77 to retain the insulator blocks 80 and 81 in the housing 50. It will be noted that the projections 97 are provided on the mounting plate 75 adjacent the insulator block 79. The projections 97 form keys which permit only a mating connector having notches which align with the projections 97 to engage the connector 52. By varying the location and number of the projections 97 and similar projections at the other end of the mounting plate 75, the connectors 52 and 54 are keyed to receive receptacles carrying only the proper voltage for a luminaire connected to the connector 56. For example, different keying arrangements may be used for circuits carrying 120 volts, 208 volts, 240 volts, 277 volts and 480 volts, all of which are commonly found in commercial installations in the United States. As a consequence of this keying arrangement, it is not possible to apply the wrong voltage to a luminaire which would then result in a dangerous condition.

Figure 8:
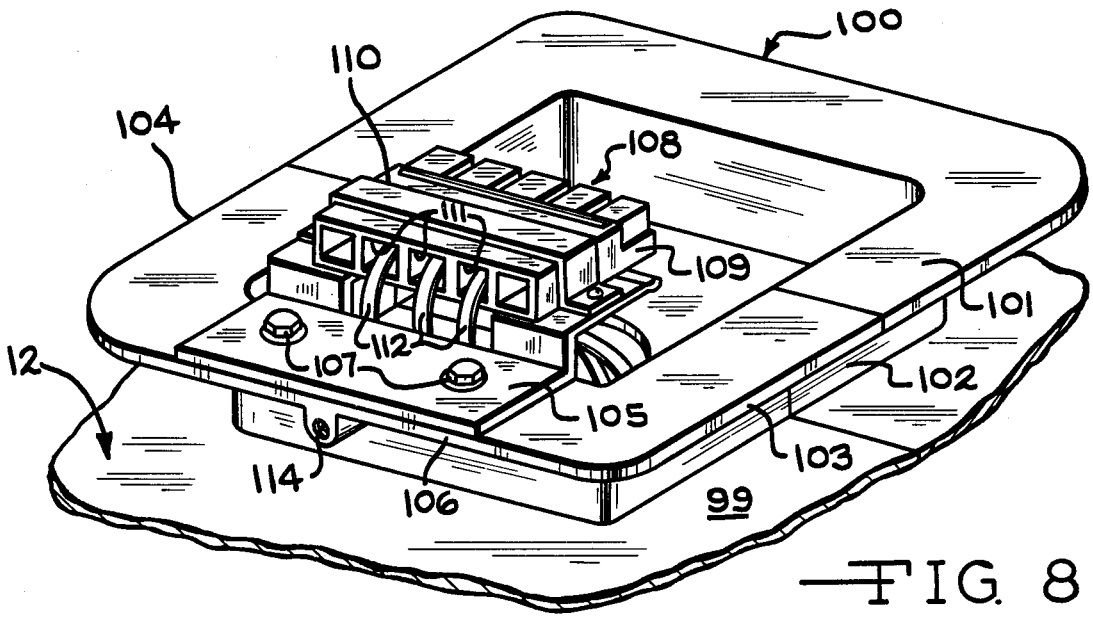
FIG. 8 is a perspective view of a connector and mounting flange on a luminaire.

Turning now to FIG. 8, details are shown for a bracket 100 formed integrally with the top of the luminaire ballast housing 12 for engaging the device 17. The bracket 100 includes a flange 101 which extends outwardly from a member 102 which projects above a flat top 99 on the ballast housing 12. The flange 101 has opposing edges 103 and 104 which are parallel and are spaced apart to be received by the grooves 31 and 35, respectively, formed in the outer housing 25 of the device 17. A bracket 105 is attached to an end portion 106 of the flange 101 with bolts 107. The bracket 105 provides a support for a connector 108 which includes an insulator block 109 and a clamp 110 attaching the insulator block 109 to the bracket 105. Or, the insulating block 109 can be bolted or otherwise attached to the bracket 105. The insulator block 109 has a plurality of openings 111 which receive the ends of electrical wires 112 and terminals (not shown) attached to such wire ends. The connector 108 is designed to mate with the connector 56 in the device 17 when the flanges 101 are slid into the grooves 31 and 35 on the device housing 25. The connector housing 50 is restricted from longitudinal movement in the outer housing 25 by the flanges 53 and 55 which abut the outer housing 25. However, the connector housing 50 can move laterally for alignment of the connector 56 with the fixture connector 108. Large lateral movement of the connector housing 50 is prevented by the openings 51 in the cover plates 40 and 42 which are only slightly larger than the portions of the connector housing 50 passing through such openings 51.

It should be noted that the cover plate 40 must be removed from the device 17 to insert the luminaire flange 101 into the grooves 31 and 35. The cover plate 40 is reinstalled on the device 17 to retain the flange 101 within the grooves 31 and 35. The cover plate 40 includes an opening 113 which aligns with an opening 114 in the luminaire flange 101. When the luminaire is mounted on the device 17 and the cover plate 40 is reinstalled, the openings 113 and 114 align to permit attachment of a screw 115 (see FIG. 9) to further retain the luminaire and the device 17 together. A similar screw 115 passes through a similar opening 113 in the cover plate 42 and threadably engages a second opening 114 in the flange 101.

Figure 9:
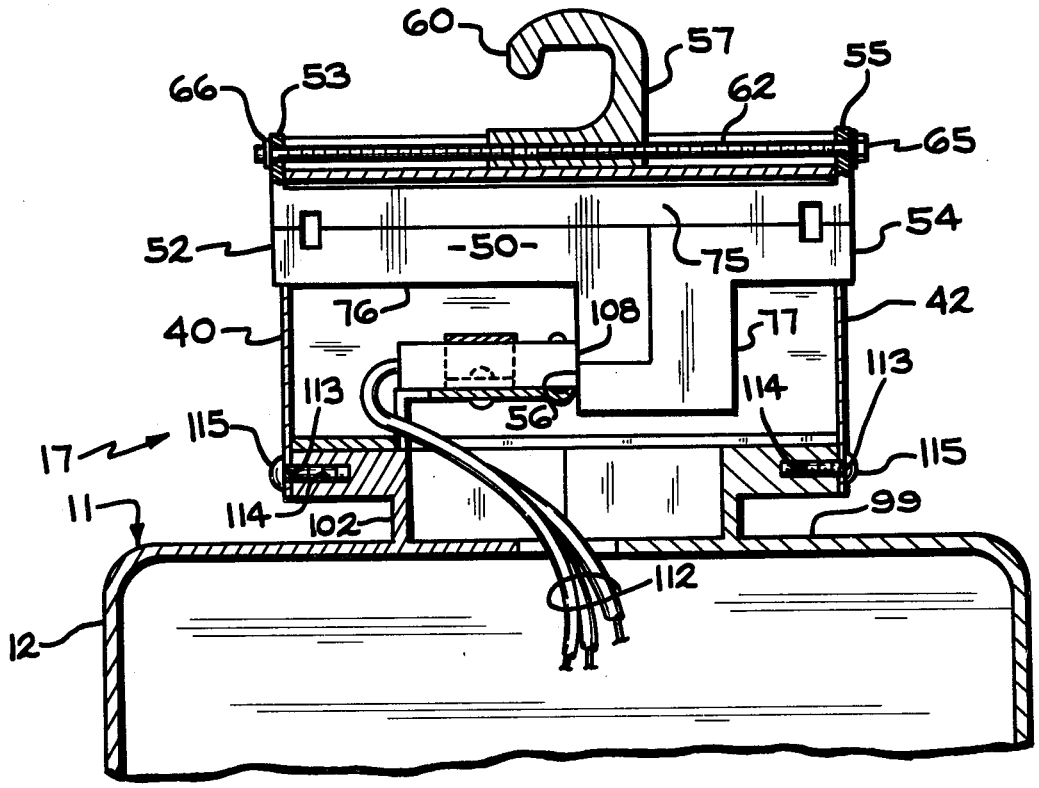
FIG. 9 is a cross sectional view taken along line 9—9 of FIG. 2.

Turning now to FIG. 9, a fragmentary cross sectional view is shown through the assembled device 17 and luminaire 11. It will be noted that when the luminaire 11 and device 17 are mechanically connected together, the connectors 108 and 56 mate for connecting circuits from the device 17 to the wires 112. The wires 112 are permanently connected to a lighting circuit in the luminaire. Connectors 21 and 22 (not shown) on the ends of cables will be attached to the connectors 52 and 54 for applying power through the device 17 to the luminaire 11 and also to the next cable which connects to another luminarie. Since the cables may be of different lengths and exert different forces on the combined luminaire 11 and device 17, it may be necessary to adjust the position of the bracket 57 by rotating the travel screw 62. This permits orienting the luminaire 11 to direct light downwardly in a vertical direction.

The above described lighting system 10 is particularly suitable for use in portable wiring systems. Any luminaire within the system can be removed from the line or circuit without interruption of power to the rest of the circuit. Furthermore, either the luminaires or the wiring or both may be relocated with minimum labor expense and without the need to manually wire the relocated circuitry. Fixtures or luminaires can be quickly and easily aligned in the field. Furthermore, the adjustable mounting bracket permits use of the device 17 with fixtures of varying sizes and weight distributions without requiring different devices 17 of the different fixtures. In some installations, the device 17 is bolted directly to the building structure. In this case, the bracket 57 is omitted and the device 17 is attached by bolts (not shown) passed through openings 116 in the top 26 of the outer housing 25. Since the device 17 is rigidly attached to the building structure, no adjustment is necessary to vertically align the luminaire.

It will be appreciated that various changes and modifications may be made in the above described lighting system 10 and device 17 for mounting and supplying electrical power to lighting fixtures in the system without departing from the spirit and scope of the following claims.

What we claim is:

1. Apparatus for mounting a luminaire on a supporting member in a building structure and for supplying power to said luminaire, said luminaire having an electrical connector mounted thereon and a lighting circuit connected to said electrical connector, said apparatus comprising a connector housing, first, second and third electrical connectors mounted in said housing with said third connector positioned to engage said luminaire connector, said first, second and third connectors having corresponding pluralities of terminals, means in said housing electrically interconnecting corresponding terminals in said first, second and third connectors, first circuit means for engaging said first connector, second circuit means for engaging said second connector, said first circuit means supplying power to said luminaire and to said second circuit means, releasable means connecting said housing to said luminaire, and third connector engaging said luminaire connector when said housing is connected to said luminaire and said third connector disengaging said luminaire connector when said housing is released from said luminaire, means for attaching said housing to the supporting member in such building structure, and wherein said housing includes an inner housing mounting said first, second and third connectors, and an outer housing mounting said inner housing with said first and second connectors projecting from said outer housing and said third connector retained in said outer housing.

2. Apparatus for mounting and supplying power to a luminaire, as set forth in claim 1, wherein said third connector and said luminaire connector engage when moved in a predetermined direction toward one another, and wherein said outer housing includes means mounting said inner housing for limited movement in said outer housing transverse to said predetermined direction while preventing movement in said predetermined direction whereby said third connector aligns with said luminaire connector during engagement.

3. Apparatus for mounting and supplying power to a luminaire, as set forth in claim 2, wherein said releasable means connecting said housing to said luminaire includes first and second spaced grooves formed in said outer housing parallel to said predetermined direction, first and second flanges on said luminaire, said flanges having a spacing and an orientation for sliding into said grooves when said luminaire and said outer housing are aligned and moved in said predetermined direction, and wherein said luminaire connector engages said third connector when said luminaire flanges are slid into said outer housing grooves.

4. Apparatus for mounting and supplying power to a luminaire, as set forth in claim 3, wherein said means for attaching said housing to the supporting member in such building includes a bracket, means for attaching said bracket to the supporting member, and means attaching said bracket to said outer housing including means for changing the location of said bracket on said outer housing to align said luminiaire with nadir.

5. Apparatus for mounting and supplying power to a luminaire, as set forth in claim 4, wherein said bracket attaching means includes a channel in said outer housing, said bracket having means slidably engaging said channel, and screw means threadably engaging said bracket for positioning said bracket in said channel.

6. Apparatus for mounting and supplying power to a luminaire, as set forth in claim 5, wherein said channel is oriented to extend across said outer housing in said predetermined direction, wherein said channel has first and second ends, and wherein said first connector is adjacent said first channel end and said second connector is adjacent said second channel end.

7. Apparatus for mounting a luminaire on a supporting member in a building structure and for supplying power to said luminaire, said luminaire having an electrical connector mounted thereon and a lighting circuit connected to said electrical connector, said apparatus comprising a connector housing, first, second and third electrical connectors mounted in said housing with said third connector positioned to engage said luminaire connector, said first, second and third connectors having corresponding pluralities of terminals, means in said housing electrically interconnecting corresponding terminals in said first, second and third connectors, first circuit means for engaging said first connector, second circuit means for engaging said second connector, said first circuit means supplying power to said luminaire and to said second circuit means, releasable means connecting said housing to said luminaire, said third connector engaging said luminaire connector when said housing is connected to said luminaire and said third connector disengaging said luminaire connector when said housing is released from said luminaire, means for attaching said housing to the supporting member in such building structure, and wherein said means for attaching said housing to the supporting member in such building includes a bracket, means for attaching said bracket to the supporting member, and means attaching said bracket to said housing including means for changing the location of said bracket on said housing to align said luminaire with nadir.

8. Apparatus for mounting and supplying power to a luminaire, as set forth in claim 7, wherein said bracket attaching means includes a channel in said outer housing, said bracket having means slidably engaging said channel, and screw means threadably engaging said bracket for positioning said bracket in said channel.

9. Apparatus for mounting a luminaire on a supporting member in a building structure and for supplying power to said luminaire, said luminaire having an electrical connector mounted thereon and a lighting circuit connected to said electrical connector, said apparatus comprising a connector housing, at least one first electrical connector and a second electrical connector mounted in said housing with said second connector positioned to engage said luminaire connector, said first and second connectors having corresponding pluralities of terminals means in said housing electrically interconnecting corresponding terminals in said first and second connectors, circuit means for engaging said first connector, said circuit means supplying power to said lighting circuit in said luminaire, releasable means connecting said housing to said luminaire, said second connector engaging said luminaire connector when said housing is connected to said luminaire and said second connector disengaging said luminaire connector when said housing is released from said luminaire, and means for attaching said housing to the supporting member in such building structure including a bracket, means for attaching said bracket to the supporting member, and means attaching said bracket to said housing including means for changing the location of said bracket on said housing to align said luminaire with nadir.

* * * * *